US008740004B2

(12) United States Patent
Mathis

(10) Patent No.: US 8,740,004 B2
(45) Date of Patent: Jun. 3, 2014

(54) SEGMENTED CONTAINER WITH ELECTRICAL COMPONENT SUPPORT ARM

(76) Inventor: Kenneth Mathis, Las Vegas, NV (US)

( * ) Notice: Subject to any disclaimer, the term of this patent is extended or adjusted under 35 U.S.C. 154(b) by 0 days.

(21) Appl. No.: 13/553,753

(22) Filed: Jul. 19, 2012

(65) Prior Publication Data

US 2014/0021205 A1 Jan. 23, 2014

(51) Int. Cl.
*B65D 1/24* (2006.01)

(52) U.S. Cl.
USPC ..... 220/500; 220/480; D3/315

(58) Field of Classification Search
USPC ..... 220/500, 556, 555, 480; D3/315; 248/58, 49, 65, 67.7, 68.1, 74.1
See application file for complete search history.

(56) References Cited

U.S. PATENT DOCUMENTS 5,170,720 A * 12/1992 Scheurer ..... 108/44
6,230,903 B1 * 5/2001 Abbott ..... 211/26
6,590,164 B2 * 7/2003 Zachrai et al. ..... 174/149 B
D524,052 S * 7/2006 Schley ..... D3/315
D525,032 S * 7/2006 Jones ..... D3/315

* cited by examiner

*Primary Examiner* — J. Gregory Pickett
*Assistant Examiner* — Raven Collins
(74) *Attorney, Agent, or Firm* — Ariel S. Bentolila; Bay Area IP Group, LLC

(57) ABSTRACT

A segmented container for easily and safely storing and transporting items related to music composition and music playing, such as electrical cables, picks, slides, capos, and rehydrating refreshments. The container includes three stepped compartments of various sizes and dimensions. The top compartment is cylindrical for holding beverage containers to prevent condensation on electrical components. The container securely attaches on amplifiers, speakers, and other devices used in the music or electrical fields. A pair of C-brackets latch onto the handles of the amplifier, and a pair of legs that create a level plane with the amplifier. A J-shaped arm extends and retracts from the container. A cable can wrap around the arm to prevent tripping and electrical accidents. The arm slides into a channel underneath the container, and locks into position with pins and holes. The outer end of the arm includes a notch for holding an amplifier cable plug.

1 Claim, 6 Drawing Sheets

SEGMENTED CONTAINER WITH ELECTRICAL COMPONENT SUPPORT ARM

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a container and supporting arm. More particularly, one or more embodiments of the invention relate to a segmented container that positions on an amplifier and secures a cable.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that containers may refer to multi-walled units used to contain, store, and transport products, people, food, animals, and an eclectic variety of other things. Containers for storing and transporting specific items such as electrical tools, electrical cables, picks, slides, capos, and drum sticks, are available.

Typically, over/under cable coiling refers to a method of storing cables that preserves the capacitance and common-mode rejection ratio built in by the manufacturer with a twist in the cable, and the shielding that encases the twisted pairs within. It allows the cable to lie flat when uncoiled, and makes for easier and faster work.

Typically, an amplifier is an electronic amplifier designed to amplify the electrical signal of an electric or acoustic guitar so that it will produce sound through a loudspeaker. Most guitar amplifiers can also modify the instrument's tone by emphasizing or de-emphasizing certain frequencies and adding electronic effects.

In view of the foregoing, it is clear that these storage techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
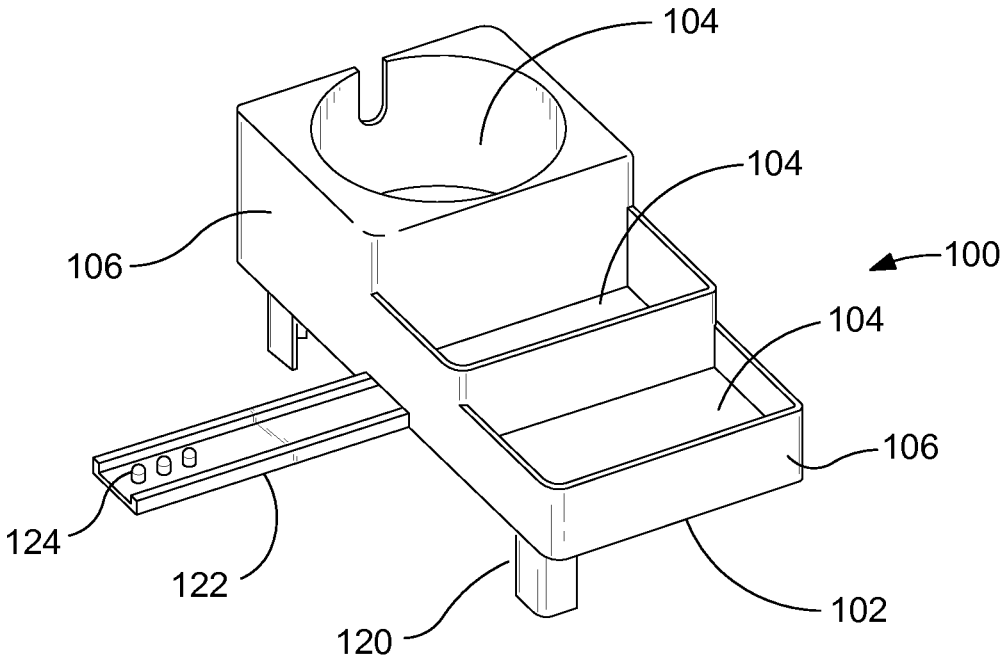
FIG. 1 illustrates an exemplary detailed perspective front top view of a segmented container, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of segmented containers 100 that may be provided by preferred embodiments of the present invention. For example, without limitation, the segmented container may provide a container 102 where at least one item 130 related to music composition and music playing including, without limitation electrical tools, electrical cables, picks, slides, capos, and rehydrating refreshments, may be stored for easy access. The segmented container may provide individuals in the music and electronic industry, including, without limitation, music stores, consumer electronics stores, and private musicians, a convenient and accessible device for storing music and electronic related items. Those skilled in the art, in light of the present teachings, will recognize that various technicians and professionals with their respective tools may utilize the segmented container, including, without limitation, electricians, plumbers, and x-ray technicians storing their respective tools and electrical components while working.

In some embodiments, the container may include at least one compartment 104 efficacious for storing each item. In some embodiments, the container may include three multi-leveled storage compartment levels. The lower two compartment levels may include at least one side panel 106. The topmost compartment level may securely host beverage containers. In some embodiments, the topmost container may include a slit for receiving the handles of the beverage containers. In some embodiments, the container may secure onto a mounting surface 128 related to the music industry, including, without limitation, an electronic device for amplifying sound, power, current, or voltage. At least one bracket 126 that extends from a bottom panel 108 of the container may join with the mounting surface. In some embodiments, the at least one bracket may include a pair of C-shaped brackets that fasten to the handles of an electronic device for amplifying sound, power, current, or voltage. In some embodiments, at least one leg 120 may extend vertically from the bottom panel to provide additional support, and prevent the segmented container from tipping over. Those skilled in the art, in light of the present teachings, will recognize that a stable leg that does not move may provide sufficient support for heavy loads inside the segmented container. In a different embodiment, each leg may adjust the height of the segmented container until a desired plane; parallel to the mounting surface is achieved. Each leg may extend vertically from the bottom panel to provide additional support to the container. Each leg may also extend and retract to achieve the segmented container is level. In yet another alternative embodiment, each leg may tilt outwardly or inwardly to compensate for various heights and obstacles on the mounting surface. In some embodiments, a support portion 110 may extend from the bottom panel for supporting an item, including, without limitation, a cable for the amplifier. A proximal end 112 of the support portion may slidably engage a channel 122 for extending and retracting the support portion from the container. Those skilled in the art, in light of the present teachings, will recognize that providing a support for the cable that allows the cable to be adjusted to any length may help avoid common trips and resultant damages on a music stage. In some embodiments, a distal end 116 of the support portion may include a notch 118 configured to support at least one item, including, without limitation, an amplifier cable plug.

FIG. 1 illustrates an exemplary detailed perspective front top view of a segmented container, in accordance with an embodiment of the present invention. In some embodiments, the container may include at least one compartment for storing and transporting at least one item. At least one side panel may form a perimeter wall around the container, and a bottom panel may provide a level surface for positioning the container. In some embodiments, the container may be dimensioned and shaped to include, without limitation, a 9"×5" area. However, other sizes may be utilized in other embodiments. Suitable materials for fabricating the container may include, without limitation, polyester resin, high-density polyethylene, polyvinyl chloride, polystyrene, polyvinyl chloride, plastic, metal, and silicone. In some embodiments, each compartment may be positioned at varied levels, forming a step configuration. In some embodiments, the compartments may form a step configuration in three levels of height in 3" length intervals. Those skilled in the art, in light of the present teachings, will recognize that varying the elevation for each item may allow for different depths for each compartment. The varying depths may be efficacious for storing various items. In some embodiments, the topmost compartment level may securely host beverage containers. The topmost container may include a slit for receiving the handles of the beverage containers. In some embodiments, two substantially rectangular compartments may include a second stepped recessed surface plane of an approximate 2" depth, and the next compartment having a ½" depth.

In one alternative embodiment, each compartment may include a different color for fast identification. In another alternative embodiment, the highest compartment may be configured into a cylindrical shape for containing a beverage container, and may be insulated with foam to inhibit temperature variances in the beverage.

Figure 2:
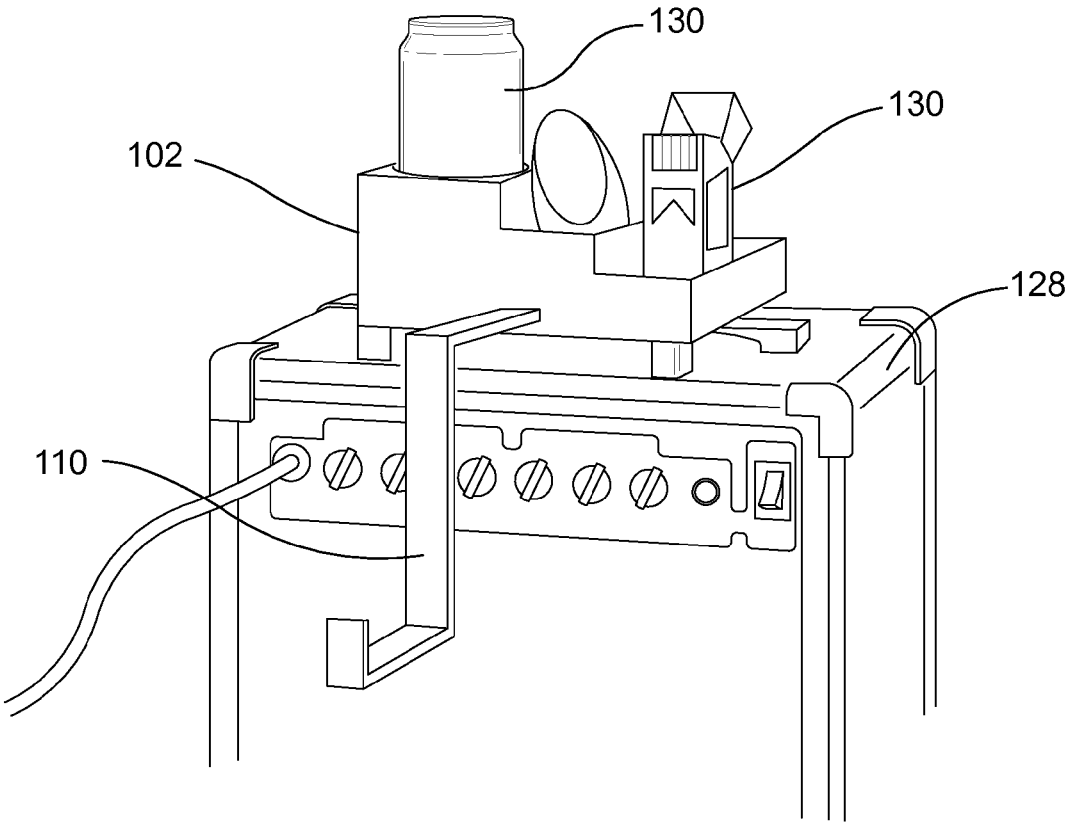
FIG. 2 illustrates an exemplary detailed perspective view of the segmented container positioned on a mounting surface with a support portion extended and at least one item stored in each compartment, in accordance with an embodiment of the present invention.

FIG. 2 illustrates an exemplary detailed perspective view of the segmented container positioned on a mounting surface with a support portion extended and at least one item stored in each compartment, in accordance with an embodiment of the present invention. In some embodiments, the segmented container may secure on top of an electronic device for amplifying sound, power, current, or voltage. However, the segmented container may also rest on any flat surface in proximity to any event, including, without limitation music event, electrically related event, sporting event, educational event, and the like. In some embodiments, there may exist a synergy between the mounting surface, which the segmented container rests on, and the items in each compartment. For example, without limitation, the segmented container resting on an amplifier, and storing a guitar pick, an amplifier cable, cough drops, and rehydrating drinks in each compartment; or the segmented container resting on an air conditioning device, and storing a thermostat, a Freon hose, an air filter, a stack of business cards, and an ammeter for measuring current and voltage in the air conditioner.

Figure 3:
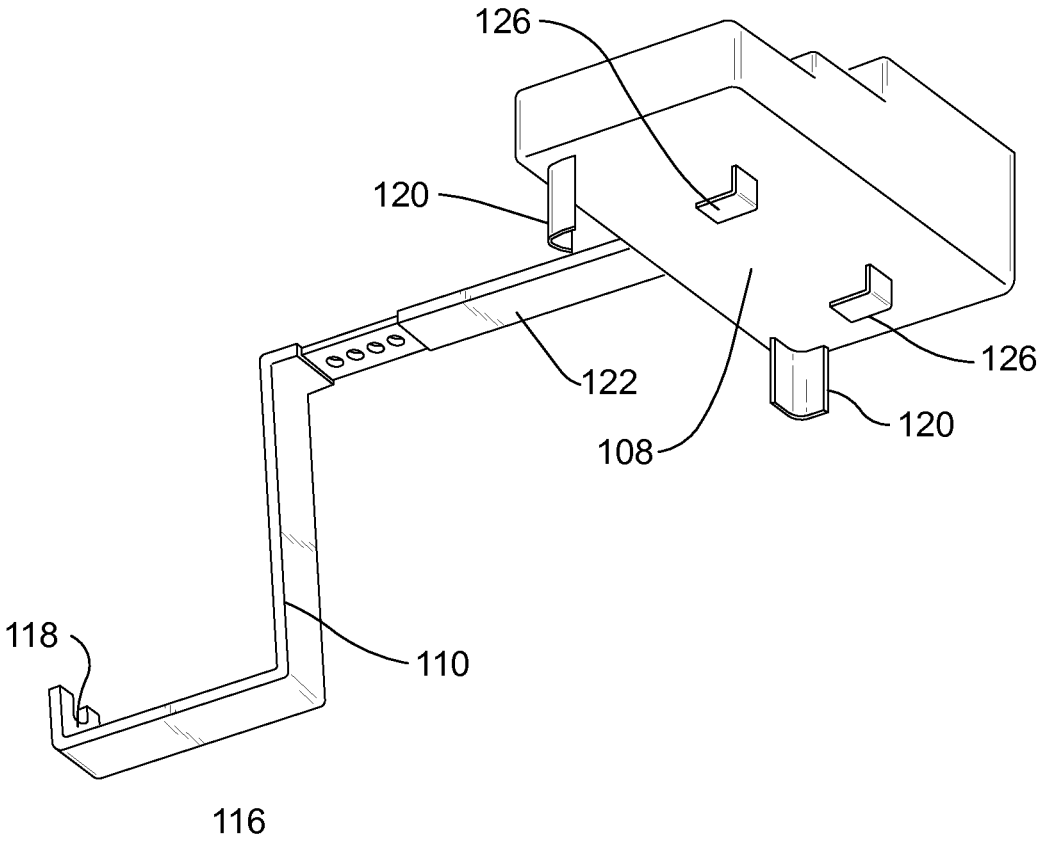
FIG. 3 illustrates an exemplary detailed perspective bottom view of the segmented container with at least one leg and at least one bracket joined to a bottom panel, in accordance with an embodiment of the present invention.

FIG. 3 illustrates an exemplary detailed perspective bottom view of the segmented container with at least one leg and at least one bracket joined to a bottom panel, in accordance with an embodiment of the present invention. In some embodiments, the bottom panel may be level and join with the at least one bracket for securely joining with the mounting surface. In some embodiments, the at least one bracket may include a C-shaped bracket efficacious for securing to a handle. In some embodiments, the C-shaped bracket may be substantially centrally located on the bottom panel. In some embodiments, each C-shaped bracket may wrap around the handle and secure to the handle with a fastener. Each bracket may be fabricated from a material having sufficient flexibility to join an eclectic variety of mounting surfaces, and still have sufficient integrity to secure the segmented container onto the mounting surface. Suitable materials for the at least one bracket may include, without limitation, metal alloy, aluminum, steel, polystyrene, polyvinyl chloride, plastic, rubber, and silicone. In some embodiments, at least one leg may also extend from the bottom panel. Those skilled in the art, in light of the present teachings, will recognize that other types of brackets may be utilized to join the segmented container to the mounting surface, including, without limitation, square brackets, angle brackets, double brackets, curly brackets, and the like. In some embodiments, at least one leg may extend vertically from the bottom panel to provide additional support, and prevent the segmented container from tipping over. Those skilled in the art, in light of the present teachings, will recognize that a stable leg that does not move may provide sufficient support for heavy loads inside the segmented container. In some embodiments, each leg may adjust the height of the segmented container until a desired plane; parallel to the mounting surface is achieved. Each leg may extend vertically from the bottom panel to provide additional support. Each leg may also extend and retract to achieve the segmented container is level. In some embodiments two legs telescopically extend and retract from the bottom panel. Each leg may lock into a desired position by twisting each leg, thereby creating a pinching effect that holds each leg into place. However, in other embodiments, a fastener, including, without limitation, a pin that passes through an aperture in the leg may lock each leg into place. In an alternative embodiment, each leg may tilt outwardly and inwardly to compensate for various heights and obstacles on the mounting surface. Suitable materials for fabricating the at least one leg may include, without limitation, polyester resin, high-density polyethylene, polyvinyl chloride, polystyrene, polyvinyl chloride, plastic, metal, and silicone.

Figure 4:
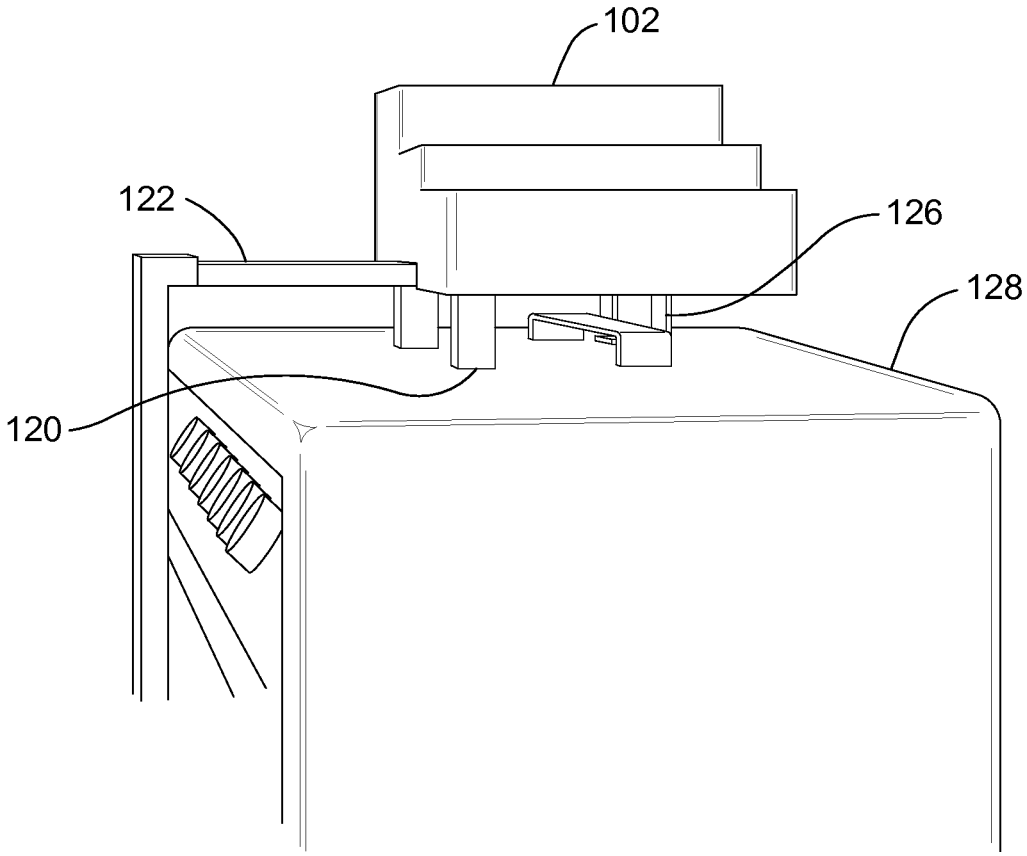
FIG. 4 illustrates an exemplary side view of the segmented container on the mounting surface, in accordance with an embodiment of the present invention.

FIG. 4 illustrates an exemplary side view of the segmented container on the mounting surface, in accordance with an embodiment of the present invention. In some embodiments, each bracket may securely join with a handle of an electronic device for amplifying sound, power, current, or voltage. In one alternative embodiment, the segmented container may join the mounting surface with an adhesive. In some embodiments, a support portion may extend from the bottom panel for supporting an item, including, without limitation, a cable for the amplifier. The support portion may include a J-shaped arm that extends perpendicularly from the bottom panel. The J-shape of the support portion may be efficacious in contouring the outer surface of the electronic device for amplifying sound, power, current, or voltage; thereby minimizing space and not impeding access to and operation of the amplifier controls. The J-shape may also provide a secure storage configuration for an electrical cable. Those skilled in the art, in light of the present teachings, will recognize that providing a support for the cable that allows the cable to be adjusted to any length may help avoid common trips and resultant damages to equipment. Suitable materials for fabricating the support portion may include, without limitation, polyester resin, high-density polyethylene, polyvinyl chloride, polystyrene, polyvinyl chloride, plastic, metal, and silicone. In one alternative embodiment, the support portion may be a separate component from the container. The support portion may not join with the container, but rather directly to the mounting surface.

Figure 5:
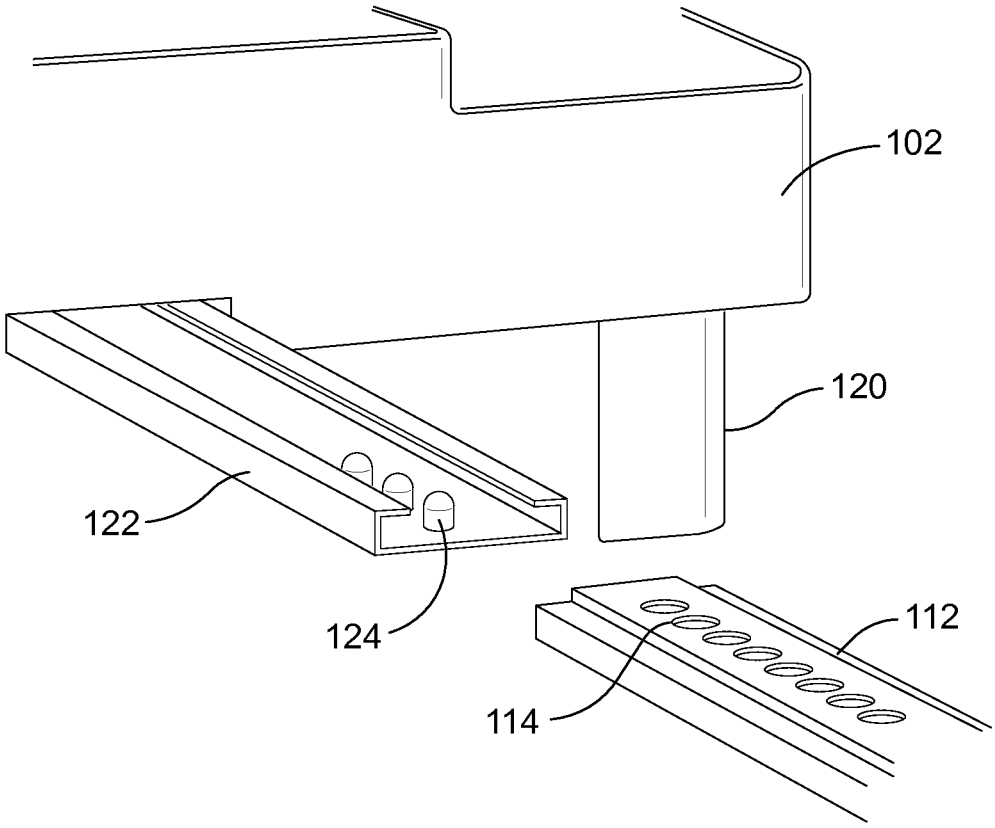
FIG. 5 illustrates an exemplary close up view of a proximal end of the support portion in proximity to a channel located in the bottom panel of the container, in accordance with an embodiment of the present invention.

FIG. 5 illustrates an exemplary close up view of a proximal end of the support portion in proximity to a channel located in the bottom panel of the container, in accordance with an embodiment of the present invention. In some embodiments, a proximal end of the support portion may slidably engage the channel located in the bottom plane. The engagement between the proximal end and the channel may extend and retract the support portion from the container. In some embodiments, the proximal end may measure 1"×5". However, other dimensions may be utilized in other embodiments. In some embodiments, the support portion may extend about 3'. However, other lengths may be utilized in other embodiments. In some embodiments, the proximal end and the channel may join securely. In some embodiments, the proximal end and the channel may detach, but join securely as an option. At least one protruding portion 124 may extend from the channel Likewise, the proximal end may include at least one aperture 114 for receiving the at least one protruding portion; thereby joining the proximal end to the channel. Those skilled in the art, in light of the present teachings, will recognize that the proximal end and the channel may join through numerous means, including, without limitation, a magnet, an adhesive, a screw, and a snap-lock.

Figure 6:
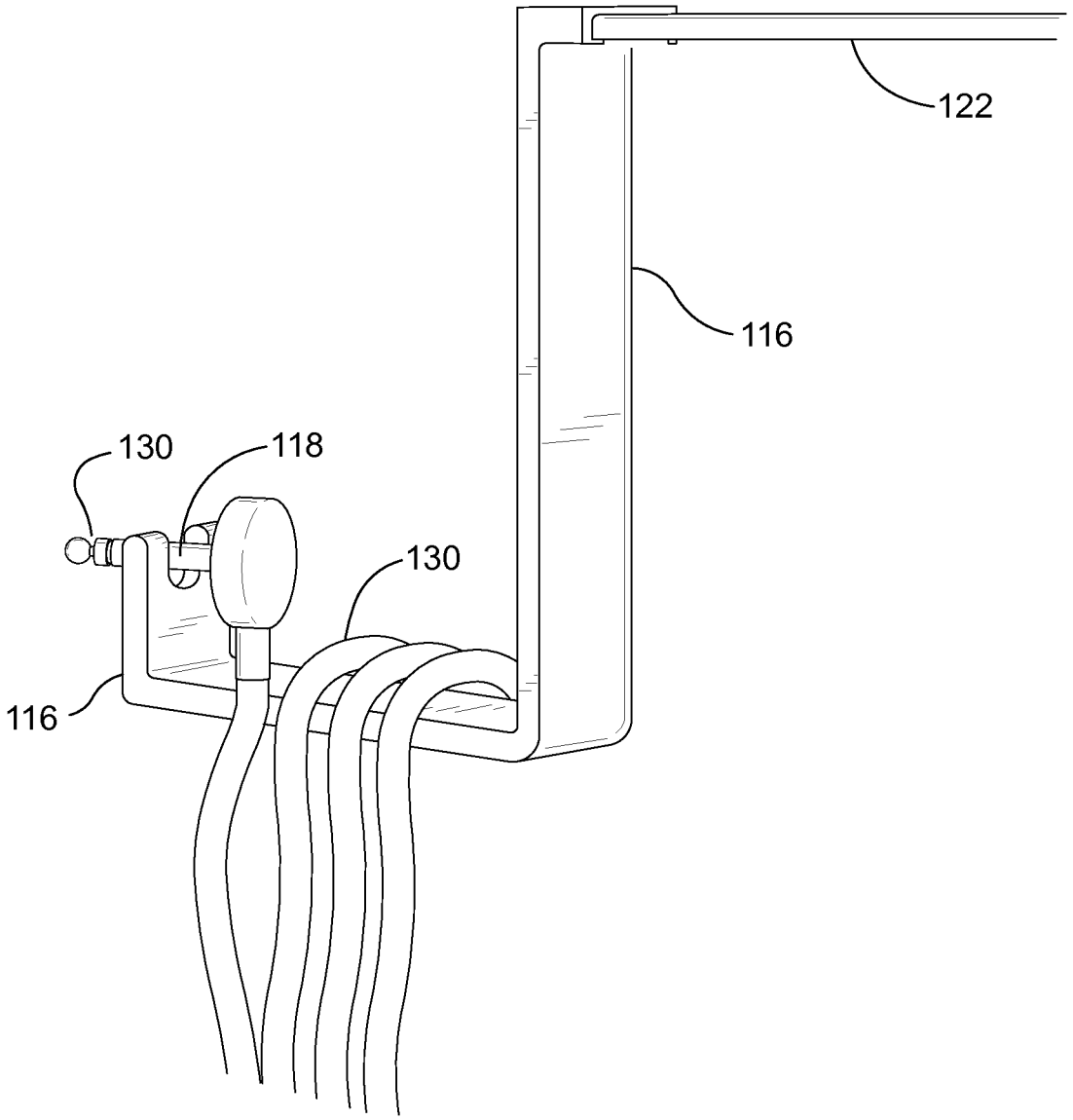
FIG. 6 illustrates an exemplary close up view of a distal end of the support portion supporting at least one item, in accordance with an embodiment of the present invention.

FIG. 6 illustrates an exemplary close up view of a distal end of the support portion supporting at least one item, in accordance with an embodiment of the present invention. In some embodiments, a distal end 116 of the support portion may include a notch 118 configured to support at least one item, including, without limitation, an amplifier cable plug. Those skilled in the art, in light of the present teachings, will recognize that the distal end may include various other shapes and dimensions for retaining an eclectic variety of at least one item. For example, without limitation, a magnet, a container, and a slot. In some embodiments, a cable may be wrapped around the distal end to store a cable. Those skilled in the art, in light of the present teachings, will recognize that over/under cable coiling refers to a method of storing cables that preserves the capacitance and common-mode rejection ratio built in by the manufacturer with a twist in the cable, and the shielding that encases the twisted pairs within. In some embodiments, over/under coiling may be utilized to store the cable.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing a segmented container with an arm that is capable of supporting an electrical component to the present invention will be apparent to those skilled in the art. Various aspects of the invention have been described above by way of illustration, and the specific embodiments disclosed are not intended to limit the invention to the particular forms disclosed. The particular implementation of the segmented container with an arm that is capable of supporting an electrical component may vary depending upon the particular context or application. By way of example, and not limitation, the segmented container with an arm that is capable of supporting an electrical component described in the foregoing were principally directed to storing music related items on an amplifier while performing music implementations; however, similar techniques may instead be applied to electricians, plumbers, and x-ray technicians storing their respective tools and electrical components while working, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A segmented container consisting of:

a container, said container comprising at least one cylindrically-shaped compartment, said cylindrically-shaped compartment comprising a slit, said slit being configured to receive a handle of a beverage container, said container further comprising at least one substantially rectangular-shaped compartment, said container further comprising at least one side panel, in which said at least one side panel comprises four substantially vertical panels, said container further comprising a bottom panel, said bottom panel comprising a channel, said channel comprising at least one protruding portion, wherein said at least one cylindrically-shaped compartment and said at least one substantially rectangular-shaped compartment are positioned at various elevations;

a support portion, said support member comprising a J-shaped arm, said support member being adjustable for extending and retracting, said support portion being configured to extend horizontally from said channel, said support portion comprising a proximal end configured to slide along said channel, said proximal end comprising at least one aperture, said at least one aperture being operable to receive said at least one protruding portion for securing said proximal end to said channel, said support portion further comprising a distal end, said distal end comprising at least one notch, wherein said at least one notch is operable to secure an amplifier cable plug;

at least one bracket, said at least one bracket comprising a C-shaped bracket, said at least one bracket being configured to extend from said bottom panel, said at least one bracket being operable to join with a mounting surface, wherein said mounting surface is an electronic device for amplifying sound, power, current, or voltage; and at least two legs, said at least two legs being configured to extend from said bottom panel, said at least two legs being operable to level said segmented container.

* * * * *